US007030820B2

(12) United States Patent
Stiller

(10) Patent No.: US 7,030,820 B2
(45) Date of Patent: Apr. 18, 2006

(54) ANTENNA ELEMENTS FOR A MISSILE

(75) Inventor: Axel Stiller, Munich (DE)

(73) Assignee: LFK-Lenkflugkoerpersysteme GmbH, Unsertschleissheim (DE)

( * ) Notice: Subject to any disclaimer, the term of this patent is extended or adjusted under 35 U.S.C. 154(b) by 29 days.

(21) Appl. No.: 10/475,488

(22) PCT Filed: Apr. 25, 2002

(86) PCT No.: PCT/DE02/01519

§ 371 (c)(1),
(2), (4) Date: May 21, 2004

(87) PCT Pub. No.: WO02/089254

PCT Pub. Date: Nov. 7, 2002

(65) Prior Publication Data

US 2004/0196196 A1 Oct. 7, 2004

(30) Foreign Application Priority Data

Apr. 27, 2001 (DE) ..... 101 20 830
Apr. 23, 2002 (DE) ..... 102 18 169

(51) Int. Cl.
*H01Q 1/28* (2006.01)

(52) U.S. Cl. ..... 343/708; 343/705

(58) Field of Classification Search ..... 343/705, 343/708, 872
See application file for complete search history.

(56) References Cited

U.S. PATENT DOCUMENTS 3,725,941 A * 4/1973 Stang ..... 343/708
4,072,952 A 2/1978 Demko ..... 343/708
4,336,543 A * 6/1982 Ganz et al. ..... 343/705
5,405,107 A * 4/1995 Bruno ..... 244/117 R
6,097,343 A * 8/2000 Goetz et al. ..... 343/708
6,175,336 B1 * 1/2001 Coughlin et al. ..... 343/708
6,237,496 B1 * 5/2001 Abbott ..... 102/384
6,286,410 B1 * 9/2001 Leibolt ..... 89/1.809

FOREIGN PATENT DOCUMENTS

| | | |
|---|---|---|
| DE | 1168513 | 12/1958 |
| DE | 3215323 | 7/1983 |
| DE | 3941125 A1 | 6/1991 |
| DE | 19715206 A1 | 10/1998 |
| DE | 19543321 | 3/1999 |
| EP | 0341772 A1 | 11/1989 |
| EP | 0406563 A1 | 1/1991 |

OTHER PUBLICATIONS

Funkschau, Jun. 1998, Microstrip-Antennen, 2 pages.

* cited by examiner

*Primary Examiner*—Hoang V. Nguyen
(74) *Attorney, Agent, or Firm*—Crowell & Moring LLP

(57) ABSTRACT

The invention relates to antenna elements for the UHF and VHF range for antennas of an airborne vehicle with empennage parts. These antenna elements are integrated into the empennage parts (L) which are made of a dielectric material and are configured in such a way that they radiate directionally broadband in flight direction. The empennage parts are made, for example, of ceramic, and the antenna elements are embedded therein or are applied to their surface.

The antenna elements (A) are preferably expanding Vivaldi-type slot radiators that are halved along their axis of symmetry and use the airborne vehicle (F) as an electrical mirror.

Arranging the antenna elements in the area of the rudder maximizes both the aperture and the distance between the phase centers of the individual elements, but no additional volume is required for the antennas.

19 Claims, 1 Drawing Sheet

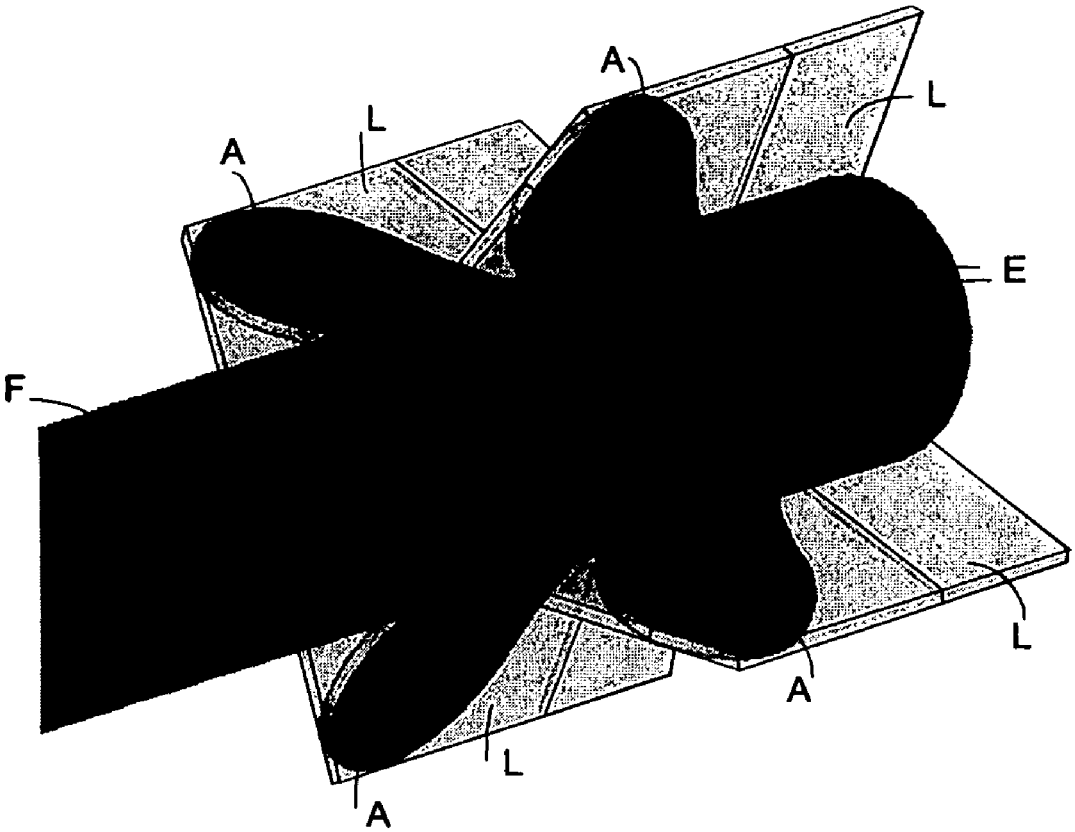
A
L
A
L
E
F
L
A
L
A

ANTENNA ELEMENTS FOR A MISSILE

CROSS REFERENCE TO RELATED APPLICATIONS

This application claims the benefit of the filing date of International Application No. PCT/DE02/01519, filed on Apr. 25, 2002, which in turn claims the benefit of the filing dates of German Patent Applications No. DE 10218169.1 filed on Apr. 23, 2002 and DE 10218169.1 filed on Apr. 27, 2001.

BACKGROUND AND SUMMARY OF THE INVENTION

The invention relates to UHF and VHF range antenna elements for antennas radiating broadband in flight direction of an airborne vehicle with empennage parts.

Helical antennas are currently used for reconnaissance and direction finding in the VHF range because of their relatively compact construction. However, at low frequencies (<1 GHz) and with structural volumes that are as small possible, these antennas either have a much reduced antenna gain, or their dimensions are not suitable for integration in the airborne vehicle.

Thus, in airborne vehicles with a length on the order of magnitude of the wavelength employed, the problem encountered within the low frequency ranges (<1 GHz) is that directionally radiating antennas, because of their aperture requirements, can no longer be arranged within the airborne vehicle, or it is no longer possible to achieve a directional antenna behavior.

German Patent DE 195 43 321 discloses an airborne vehicle with antenna elements integrated in dielectric wing elements for communications purposes. From Funkschau 6, 1998, Antennen [Antennas], Part 10, it is further known to arrange planar antennas on dielectric ceramic substrates.

The resulting planar structures, however, (e.g., patch antennas) do not have the directional effect necessary for direction finding. Furthermore, this type of antenna used in the two cited sources cannot be arranged on the airborne vehicles available for the application such that radiation in flight direction is achieved. Even the arrangement in an array as described in the first cited source—if the required surface were available—does not change this fact because the gain is clearly reduced if the radiation is deflected from the surface normal by more than 60°.

A further reason why patch elements appear unsuitable for the application according to the invention is the required broadbandedness, which at 1:20 cannot be achieved with the described antennas. This antenna type is thus in principle unsuitable for the planned direction finding in flight direction.

Antennas with an externally similar construction are used in communications technology (e.g., aerodynamically shaped blade antennas in rail vehicles). The essential difference compared to these structures is the physical separation of radome and antenna and the fact that these antennas radiate non-directionally.

The object of the invention is to provide an antenna arrangement in which the antenna elements, despite the spatial and the mechanical limitations imposed by the airborne vehicle, exhibit the required behavior, i.e., in particular, radiate directionally broadband in flight direction.

According to the invention this object is attained by the features set forth in the characterizing part of Claim 1.

Thus, the empennage of the airborne vehicle is used to integrate antenna structures that radiate directionally broadband in flight direction without interfering with the mechanical functionality of the empennage area.

BRIEF DESCRIPTION OF THE DRAWINGS

An exemplary embodiment is illustrated in the FIGURE which shows one possible configuration of the fin antenna according to the invention.

DETAILED DESCRIPTION OF THE DRAWINGS

The FIGURE shows one possible configuration of the fin antenna according to the invention. It consists of a dielectric empennage L in which the antenna structure A with the feed line E is embedded or applied to the surface. Due to the low frequencies, the employed dielectric material affects the properties of the antenna elements only to a minor extent. Thus, a structural integration of antenna and rudder is achieved (positive connection and frictional connection) such that additional protective measures for the antenna in the form of a radome are eliminated.

The employed antenna element A is based on an expanding slot radiator, which is halved along its axis of symmetry. The entire airborne vehicle F is included in the antenna concept. In the literature, this type of antenna is also termed a Vivaldi element. Novel in this connection is the idea of halving the antenna element and using the airborne vehicle as an electrical mirror despite its small dimensions compared to the wavelength.

Thus, unlike in conventional antenna concepts in which the support is large compared to the wavelength and thus can be considered a metallic plane, in the design according to the invention, the structure of the airborne vehicle F forms part of the antenna.

This novel arrangement of the antenna element A in the area of the rudder L maximizes both the aperture and the distance between the phase centers of the individual elements, but without requiring any additional volume for the antennas. If the conventional amplitude modulation method or the phase monopulse method is used to analyze the received signals, the proposed arrangement keeps the requirements for the detection channels low. This makes it possible to expand the frequency range for direction finding and reconnaissance to include lower frequencies (currently 100 MHz). For a bearing in azimuth and elevation for all polarizations, a total of 4 antenna elements are required, which are orthogonally polarized in pairs. Such an arrangement is in principle already described in DE 1168513. In contrast thereto, the antenna system according to the invention is oriented at a 45° angle. This orientation is essential for the present application because only this makes it possible to achieve the required polarization agility, namely linear horizontal and linear vertical polarization as well as counterclockwise or clockwise circular polarization during direction finding.

In summary, the structure according to the invention has the following advantages: direction finding and reconnaissance in flight direction, expansion of the frequency range for direction finding and reconnaissance at lower frequencies (currently 100 MHz), reduction of the volume required by the antennas, a maximum antenna aperture with a maximum distance between phase centers, and the structural integration of the antenna in the airborne vehicle (positive connection and frictional connection).

What is claimed is:

1. An antenna for ultra high frequency (UHF) and very high frequency (VHF) range incorporated into an airborne vehicle, comprising:

empennage parts made of a dielectric material extending radially in different directions; and antenna elements integrated with said empennage parts, wherein the antenna elements are configured to radiate directionally broadband in flight direction.

2. An antenna for ultra high frequency (UHF) and very high frequency (VHF) range incorporated into an airborne vehicle, comprising:

empennage parts made of a dielectric material; and antenna elements integrated with said empennage parts, wherein the antenna elements are configured to radiate directionally broadband in flight direction;

wherein the empennage parts are made of a ceramic material and the antenna elements are embedded within the ceramic material.

3. An antenna for ultra high frequency (UHF) and very high frequency (VHF) range incorporated into an airborne vehicle, comprising:

empennage parts made of a dielectric material; and antenna elements integrated with said empennage parts, wherein the antenna elements are configured to radiate directionally broadband in flight direction;

wherein the empennage parts are made of a ceramic material and the antenna elements are disposed on said ceramic material.

4. An antenna for ultra high frequency (UHF) and very high frequency (VHF) range incorporated into an airborne vehicle, comprising:

empennage parts made of a dielectric material; and antenna elements integrated with said empennage parts, wherein the antenna elements are configured to radiate directionally broadband in flight direction;

wherein said antenna elements comprise expanding slot radiators that are halved along an axis of symmetry and use the airborne vehicle as an electrical mirror.

5. The antenna of claim 4, wherein the empennage parts comprises four antenna elements arranged on or within respective empennage parts and are orthogonally polarized in pairs such that the antenna system is oriented at a 45° angle.

6. An airborne vehicle, comprising:

an empennage comprising a plurality of empennage members extending radially in different directions, wherein said empennage members respectively comprise a dielectric material; and a plurality of antenna elements integrated respectively with said empennage members.

7. The airborne vehicle of claim 6, wherein said empennage members respectively comprise ceramic materials and said antenna elements are respectively embedded within said ceramic materials.

8. The airborne vehicle of claim 6, wherein said empennage members respectively comprise ceramic materials and said antenna elements are respectively disposed on said ceramic materials.

9. The airborne vehicle of claim 6, wherein said antenna elements respectively comprise expanding slot radiators.

10. The airborne vehicle of claim 9, wherein said expanding slot radiators are configured to use said airborne vehicle as an electrical mirror.

11. The airborne vehicle of claim 6, wherein the empennage members respectively comprise four antenna elements orthogonally polarized in pairs such that the antenna is oriented at a 45° angle.

12. The airborne vehicle of claim 6, wherein at least one of said empennage member comprises a rudder.

13. An empennage for an airborne vehicle, comprising:

a plurality of empennage members, wherein said empennage members are respectively formed of a dielectric material; and a plurality of antenna elements integrated respectively with said empennage members.

14. The empennage of claim 13, wherein said empennage members respectively comprise ceramic materials and said antenna elements are respectively embedded within said ceramic materials.

15. The empennage of claim 13, wherein said empennage members respectively comprise ceramic materials and said antenna elements are respectively disposed on said ceramic materials.

16. The empennage of claim 13, wherein said antenna elements respectively comprise expanding slot radiators.

17. The airborne vehicle of claim 16 wherein said expanding slot radiators are configured to use said airborne vehicle as an electrical mirror.

18. The airborne vehicle of claim 13, wherein the empennage members respectively comprise four antenna elements orthogonally polarized in pairs such that the antenna is oriented at a 45° angle.

19. The airborne vehicle of claim 13, wherein at least one of said empennage member comprises a rudder.

* * * * *